US007533737B2

(12) United States Patent
Hall et al.

(10) Patent No.: US 7,533,737 B2
(45) Date of Patent: May 19, 2009

(54) JET ARRANGEMENT FOR A DOWNHOLE DRILL BIT

(76) Inventors: David R. Hall, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 98 days.

(21) Appl. No.: 11/673,936

(22) Filed: Feb. 12, 2007

(65) Prior Publication Data

US 2007/0125580 A1 Jun. 7, 2007

Related U.S. Application Data

(63) Continuation-in-part of application No. 11/673,872, filed on Feb. 12, 2007, now Pat. No. 7,484,576, which is a continuation-in-part of application No. 11/611,310, filed on Dec. 15, 2006, and a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, and a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 10/26* (2006.01)
*E21B 10/60* (2006.01)

(52) U.S. Cl. ..... 175/393; 175/385

(58) Field of Classification Search ..... 173/393, 173/385, 420.1, 420.2, 418, 414, 415, 389; 175/393, 385, 420.1, 420.2, 418, 414, 415, 175/389

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 6/1921 | Midgett |
| 1,460,671 | A | 7/1923 | Hebsacker |

(Continued)

*Primary Examiner*—Hoang Dang
(74) *Attorney, Agent, or Firm*—Tyson J. Wilde

(57) ABSTRACT

A drill bit having a bit body, and axis of rotation, and a working face, the working face having a plurality of cutting elements. A jack element extends from the working face and is coaxial with the axis of rotation and is a hard metal insert. A plurality of high pressure jets are disposed within the working face and surround the jack element, wherein at least one jet is disposed at least as close to the jack element as an inner most cutting element of the plurality of cutting elements.

19 Claims, 11 Drawing Sheets

U.S. PATENT DOCUMENTS 1,544,757 A 7/1925 Hufford
1,821,474 A 9/1931 Meroer
1,879,177 A 9/1932 Gault
2,054,255 A 9/1936 Howard
2,064,255 A 12/1936 Garfield
2,100,692 A * 11/1937 Harman ..... 525/332.7
2,169,223 A 8/1939 Christian
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,807,443 A * 9/1957 Wyman ..... 175/404
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schonfield
3,583,504 A 6/1971 Aalund
3,688,852 A * 9/1972 Gaylord et al. ..... 175/393
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A * 3/1998 Nelson ..... 175/385
5,794,728 A * 8/1998 Palmberg ..... 175/400
5,896,938 A 4/1999 Moeny
5,947,215 A * 9/1999 Lundell ..... 175/417
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,269,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang et al.
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 * 5/2004 Mensa-Wilmot ..... 175/385
6,732,817 B2 5/2004 Dewey
6,822,579 B2 11/2004 Goswani
6,953,096 B2 10/2005 Glenhill
2003/0213621 A1 11/2003 Britten
2004/0238221 A1 12/2004 Runia
2004/0256155 A1 12/2004 Kriesels
2005/0072598 A1 4/2005 Fanuel et al.

* cited by examiner

JET ARRANGEMENT FOR A DOWNHOLE DRILL BIT

CROSS REFERENCE TO RELATED APPLICATIONS

This Patent Application is a continuation-in-part of U.S. patent application Ser. No. 11/673,872 filed on Feb. 12, 2007 now U.S. Pat. No. 7,484,576 and entitled Jack Element in Communication with an Electric Motor and/or Generator. U.S. patent application Ser. No. 11/673,872 is a continuation-in-part of U.S. patent application Ser. No. 11/611,310 filed on Dec. 15, 2006 and which is entitled System for Steering a Drill String. This Patent Application is also a continuation-in-part of U.S. patent application Ser. No. 11/278,935 filed on Apr. 6, 2006 now U.S. Pat. No. 7,426,968 and which is entitled Drill Bit Assembly with a Probe. U.S. patent application Ser. No. 11/278,935 is a continuation-in-part of U.S. patent application Ser. No. 11/277,394 which filed on Mar. 24, 2006 now U.S. Pat. No. 7,398,837 and entitled Drill Bit Assembly with a Logging Device. U.S. patent application Ser. No. 11/277,394 is a continuation-in-part of U.S. patent application Ser. No. 11/277,380 also filed on Mar. 24, 2006 now U.S. Pat. No. 7,337,858 and entitled A Drill Bit Assembly Adapted to Provide Power Downhole. U.S. patent application Ser. No. 11/277,380 is a continuation-in-part of U.S. patent application Ser. No. 11/306,976 which was filed on Jan. 18, 2006 now U.S. Pat. No. 7,360,610 and entitled "Drill Bit Assembly for Directional Drilling." U.S. patent application Ser. No. 11/306,976 is a continuation-in-part of Ser. No. 11/306,307 filed on Dec. 22, 2005 now U.S. Pat. No. 7,225,886, entitled Drill Bit Assembly with an Indenting Member. U.S. patent application Ser. No. 11/306,307 is a continuation-in-part of U.S. patent application Ser. No. 11/306,022 filed on Dec. 14, 2005, now U.S. Pat. No. 7,198,119 entitled Hydraulic Drill Bit Assembly. U.S. patent application Ser. No. 11/306,022 is a continuation-in-part of U.S. patent application Ser. No. 11/164,391 filed on Nov. 21, 2005, now U.S. Pat. No. 7,270,196 which is entitled Drill Bit Assembly. All of these applications are herein incorporated by reference in their entirety.

BACKGROUND OF THE INVENTION

This invention relates to drill bits, specifically drill bit assemblies for use in oil, gas and geothermal drilling. Often drill bits are subjected to harsh conditions when drilling below the earth's surface. Replacing damaged drill bits in the field is often costly and time consuming since the entire downhole tool string must typically be removed from the borehole before the drill bit can be reached. Bit balling in soft formations and bit whirl in hard formations may reduce penetration rates and may result in damage to the drill bit. Further, loading too much weight on the drill bit when drilling through a hard formation may exceed the bit's capabilities and also result in damage. Too often unexpected hard formations are encountered suddenly and damage to the drill bit occurs before the weight on the drill bit may be adjusted.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a downhole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the filling component. One or more drilling parameters (weight on bit, rotary speed, etc.) is then altered to reduce or eliminate such destructive vibration.

BRIEF SUMMARY OF THE INVENTION

A drill bit having a bit body, and axis of rotation, and a working face, the working face having a plurality of fixed cutting elements. A jack element extends from the working face and is coaxial with the axis of rotation and is a hard metal insert. A plurality of high pressure jets are disposed within the working face and surround the jack element, wherein at least one jet is disposed at least as close to the jack element as an inner most cutting element of the plurality of cutting elements. The bit may be a shear bit or a percussion bit.

The jack element may comprise a surface comprising a material with a hardness of at least 63 HRc. The material may comprise a polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof. The jack element may be rotationally isolated from the bit body of the drill bit and at least one jet may be rotationally fixed to the jack element.

At least a portion of a fluid pathway connecting a bore of the bit body to the at least one jet may be disposed within an axial groove at a proximal end of the jack element. A fluid pathway may connect a bore of the bit body to a plurality of jets.

The jets may be disposed within junk slots in the working face. The junk slots may comprise a width of 0.75 inches to half the distance between adjacent arrays of cutting elements. The junk slots may also comprise a depth of 0.6 inches to 2 inches. The jets may be adapted to apply at least 5,000 psi. The at least one jet may be flush with the jack element. The at least one jet may be formed in a portion of the jack element. In some embodiments, the at least one jet is adjacent the jack element. The at least one jet may be closer to the jack element than the inner most cutting element. The at least one jet may be a vortex nozzle. The at least one jet may be directed towards a distal end of the jack element. The at least one jet may be angled such that it emits a stream in a direction non-perpendicular to the working face.

The at least one jet may be formed in a ring disposed around the jack element. The ring may comprise a hard material selected from the group consisting of polycrystalline diamond, natural diamond, synthetic diamond, silicon bonded diamond, cobalt bonded diamond, thermally stable diamond, polished diamond, layered diamond, chromium, cubic boron nitride, tungsten carbide, titanium, niobium, or combinations thereof.

In another embodiment of the invention, a drill bit comprises an axis of rotation and a working face comprising a plurality of blades extending outwardly from a bit body. The blades may form in part a plurality of junk slots which converge proximate the axis of rotation and diverge radially towards a gauge of the bit. A plurality of cutting elements may comprise a cutting surface arrayed along the blades. A jack element may be coaxial with the axis of rotation and may be a hard metal insert. A plurality of high pressure jets may be disposed within the working face and surround the jack element, the jets being adapted to apply at least 5,000 psi. The at least one jet may be disposed at least as close to the jack element as an inner most cutting element attached to at least one of the plurality of blades.

DETAILED DESCRIPTION OF THE INVENTION AND THE PREFERRED EMBODIMENT

Figure 1:
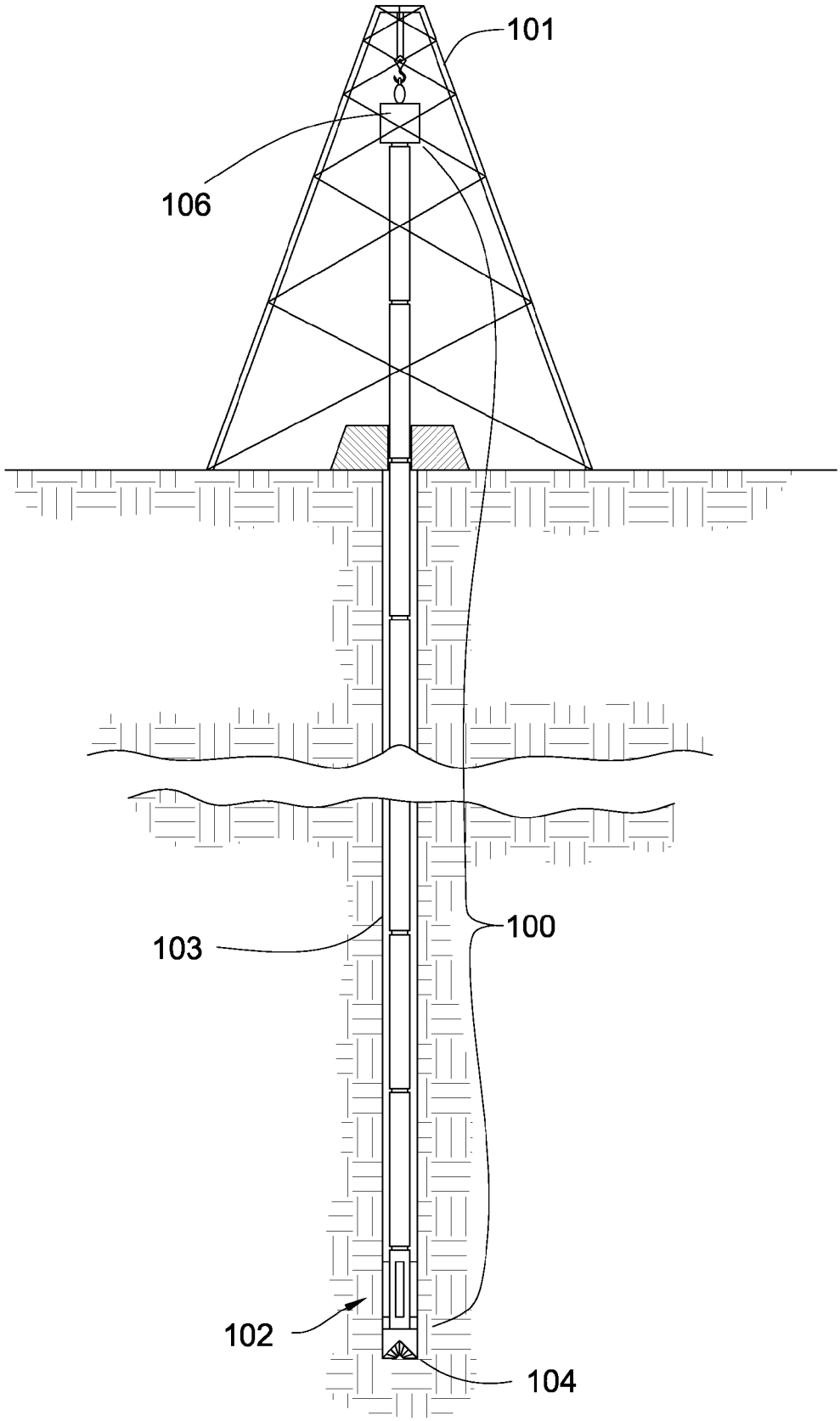
FIG. 1 is a cross-sectional diagram of an embodiment of a drill string suspended in a bore hole.

FIG. 1 is an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. A preferred data transmission system is disclosed in U.S. Pat. No. 6,670,880 to Hall, which is herein incorporated by reference for all that it discloses. However, in some embodiments, the no telemetry system is used. Mud pulse, short hop, or EM telemetry systems may also be used with the present invention.

Figure 2:
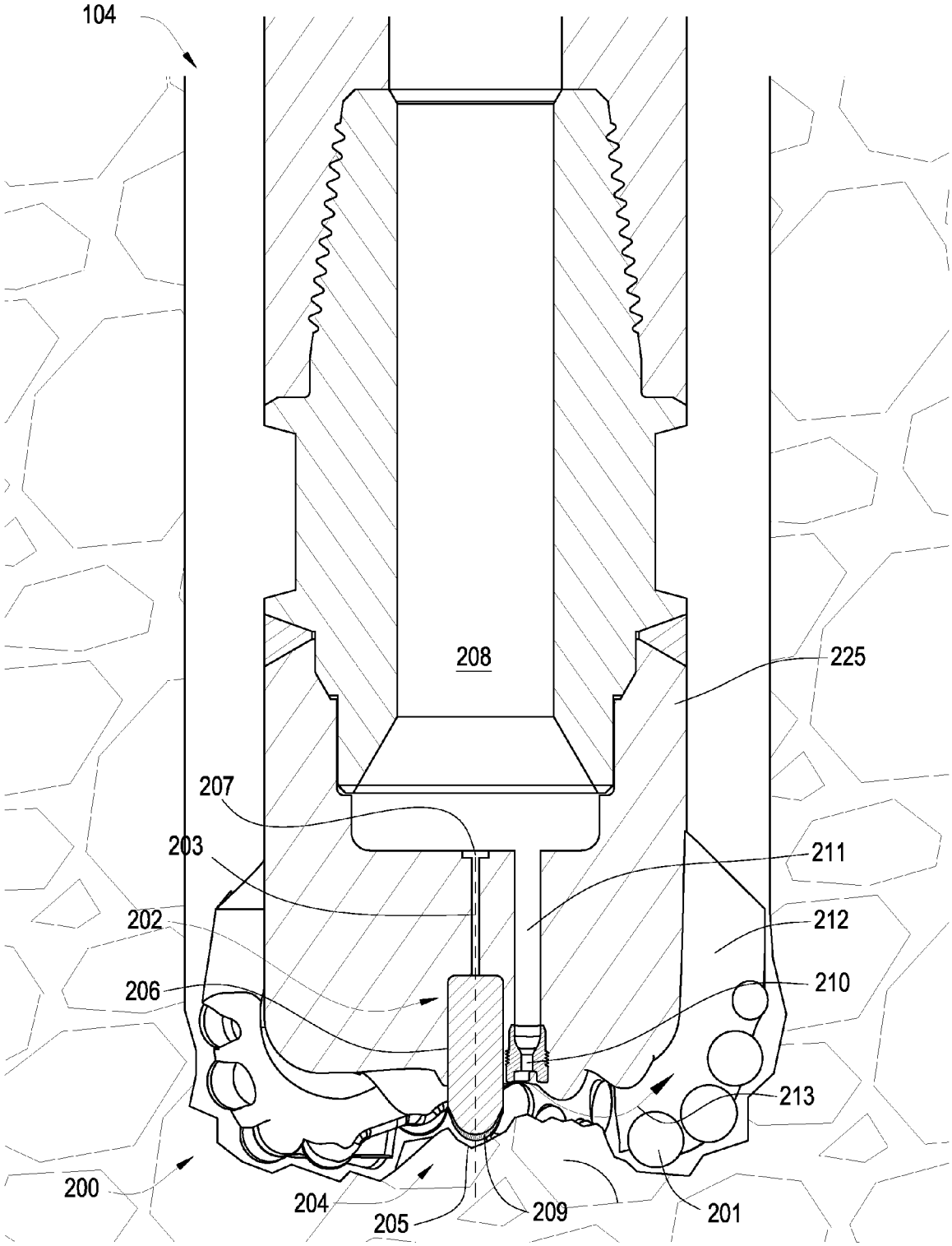
FIG. 2 is a cross-sectional diagram of an embodiment of a drill bit.
Figure 3:
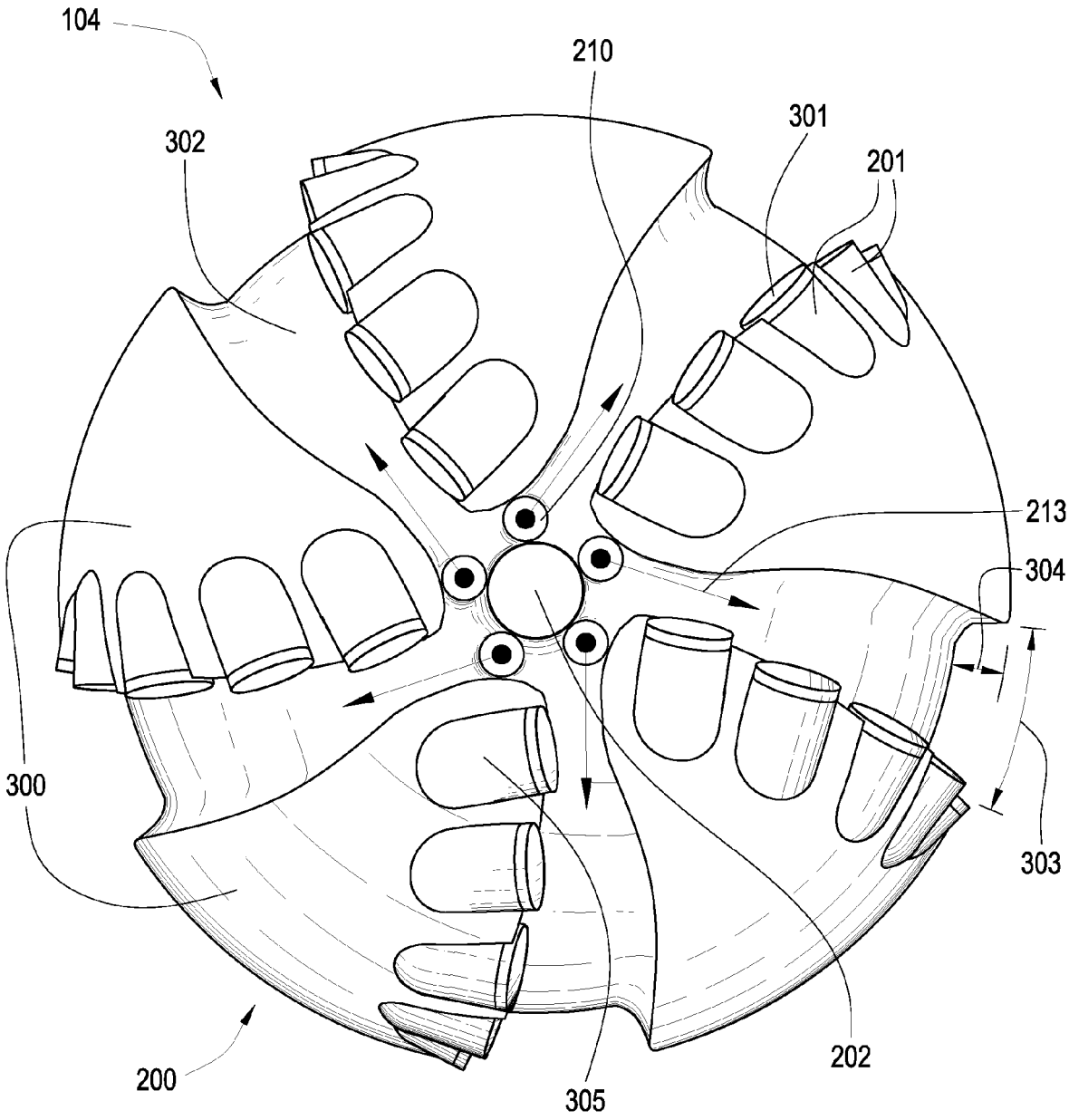
FIG. 3 is an orthogonal diagram of another embodiment of a drill bit.

Referring to FIGS. 2 and 3, the drill bit 104 may be a shear bit. The bit 104 comprises a working face 200 having a plurality of fixed cutting elements 201 which degrade the formation while the bit rotates. The cutting elements 201 may be 13-19 mm in diameter. A jack element 202 coaxial with the axis of rotation 203 of the bit is disposed within and extends from the working face 200. The shape of the working face 200 and the arrangement of the cutting elements 201 are such that as the bit rotates, a raised portion 204 is formed in the formation. The jack element 202 compresses the center of the raised portion 204, creating an indention 205 in the raised portion 204. The indention 205 may help stabilize the drill bit 104 and may reduce bit whirl by maintaining the jack element 202 centered about the indention 205.

The jack element 202 may be a hard, metal insert which may be brazed or press fit into a recess 206 in the working face 200. The hard metal may comprise a tungsten carbide, niobium carbide, a cemented metal carbide, hardened steel, titanium, tungsten, aluminum, chromium, nickel, or combinations thereof. A port 207 may be drilled in the bit from the bore 208 of the bit 104 to the recess 206 to allow air to escape if the jack element 202 is press fit into the recess 206. The jack element 202 may comprise a surface 209 comprising a hard material with a hardness of at least 63 HRc, which may lengthen the lifetime of the jack element 202 and may aid in compressing harder formations. The hard material may comprise a polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof.

The working face 200 may comprise a plurality of blades 300 extending outwardly from the bit body 225. In the embodiment of FIG. 3, the working face 200 comprises five blades 300, though the working face 200 may comprise any number of blades 300. The cutting elements 201 comprise a cutting surface 301 and may be arrayed along the blades 300. The cutting surface 301 of the cutting elements 201 preferably comprises a hard material with a hardness of at least 63 HRc. The blades 300 form in part a plurality of junk slots 302 which converge proximate the axis of rotation 203 on the working face 200 and diverge radially towards a gauge of the bit.

In order to clear the cuttings away from the cutting elements 201 and working face 200, a plurality of high pressure jets 210 are disposed within the junk slots 302 in the working face 200, surrounding the jack element 202. It is believed that by placing the jets as close as possible to the jack element that cuttings which may pack in against the sides of the jack element may be removed. Placing the jets as close as possible to the jack element may also provide the advantage of all of the fluid emitted from the jets is directed in a single direction, thus maximizing the energy for cleaning the blades of the bit. A jet 210 may be proximate each blade 300. The jets 210 are connected to the bore 208 of the drill bit 104 through fluid pathways 211 formed in the bit body. The jets 210 may comprise replaceable nozzles disposed within the working face 200. Fluid passes through the fluid pathways 211 from the bore 208 and is emitted from the jets 210 at a high velocity. The high velocity fluid passes through the junk slots 302 in the working face 200 and gauge 212 of the bit 104 and clears the cuttings away from the working face 200.

The junk slots 302 may be narrow and shallow such that the fluid flows from the jets 210 to the gauge 212 at a higher velocity in order to better clean the cutting elements 201 and blades 300. Preferably, the junk slots 302 comprise a width 303 from 0.75 inches to half the distance between arrays of cutting elements 201 on different blades 300 of the working face 200. The junk slots 302 may also comprise a depth 304 from 0.6 inches to 2 inches. Preferably, the jets 210 may be disposed within the junk slots 302 at positions that minimize erosion of the working face 200 and cutting elements 201 due to the emitted fluid streams.

At least one of the jets 210 is disposed at least as close to the jack element 202 as an inner most cutting element 305 of the plurality of cutting elements 201. Close proximity to the jack element 202 allows the jet 210 to take advantage of the fluid dynamics caused by the raised portion 204 of the formation. Fluid emitted from the jet 210 may follow a path 213 defined by the raised portion 204 of the formation and the working face 200 of the bit or the junk slot 302, leading from the raised portion outward toward the gauge 212. This configuration may also allow the jet 210 to better clean the inner most cutting element 305. The jets 210 may emit a stream of fluid about 0.75 inches in diameter, which may result in more efficient cleaning of the cutting elements 201.

The jets 210 may also be used to erode the formation when the fluid is emitted at a high enough velocity due to the pressure provided by the nozzles. The high pressure nozzles may be adapted to apply at least 5,000 psi to the fluid, preferably at least 10,000 psi, in order to effectively erode the formation.

Figure 4:
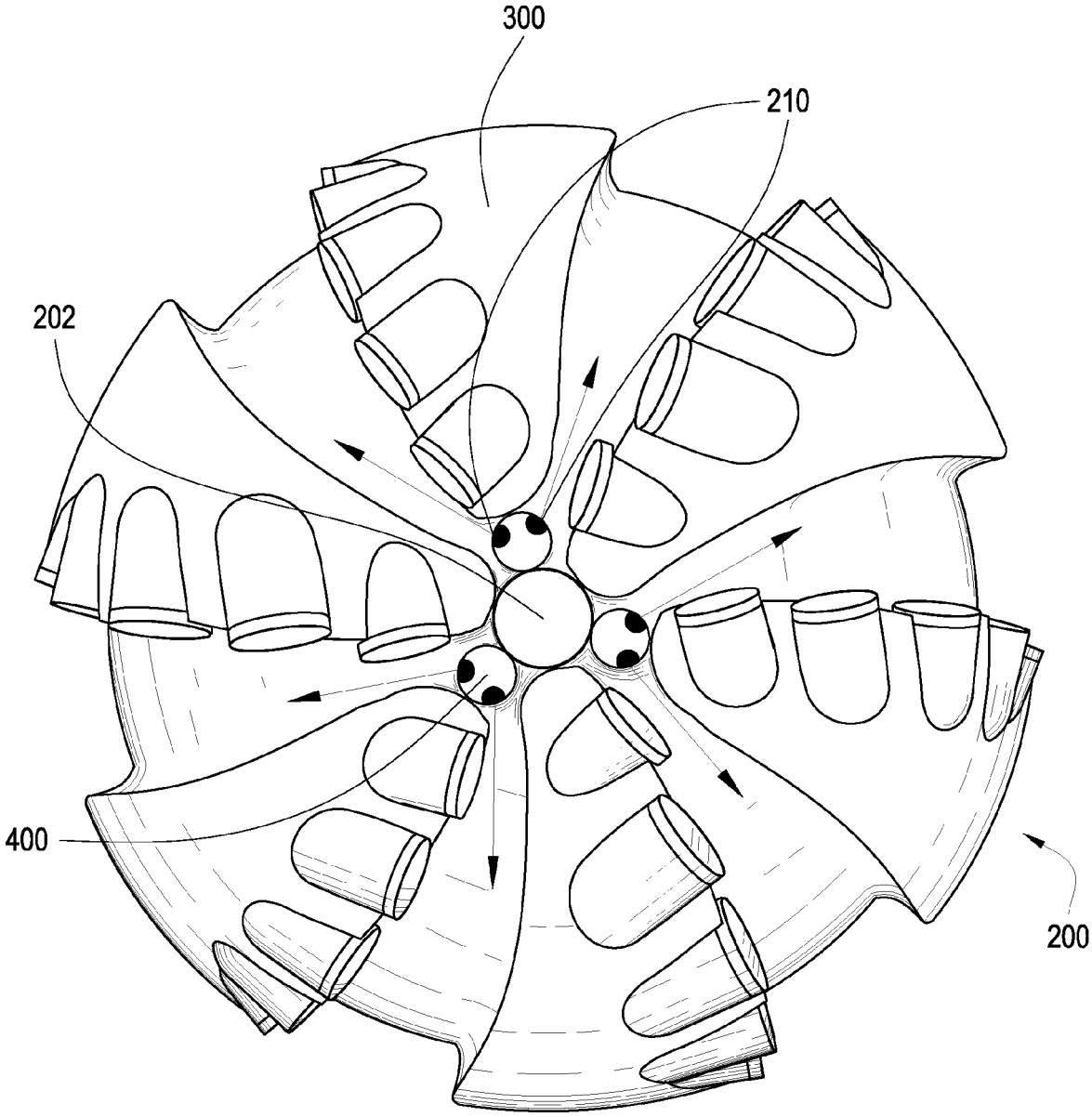
FIG. 4 is an orthogonal diagram of another embodiment of a drill bit.

Referring to the embodiment of FIG. 4, the working face 200 comprises 6 blades 300. Due to the higher number of blades on the working face, the jets 210 may be adapted to occupy a smaller space. A plurality of jets 210 may be formed in a single nozzle 400 such that the working face 200 comprises a single nozzle 400 for more than one blade. Each jet 210 may be directed to emit a stream in a different direction. The blades 300 may be staggered on the working face 200 such that some are farther from the jack element 202 than others, allowing room for the jets 210 to be placed in between the jack element 202 and the blades 300 spaced farther from the jack element 202.

Figure 5:
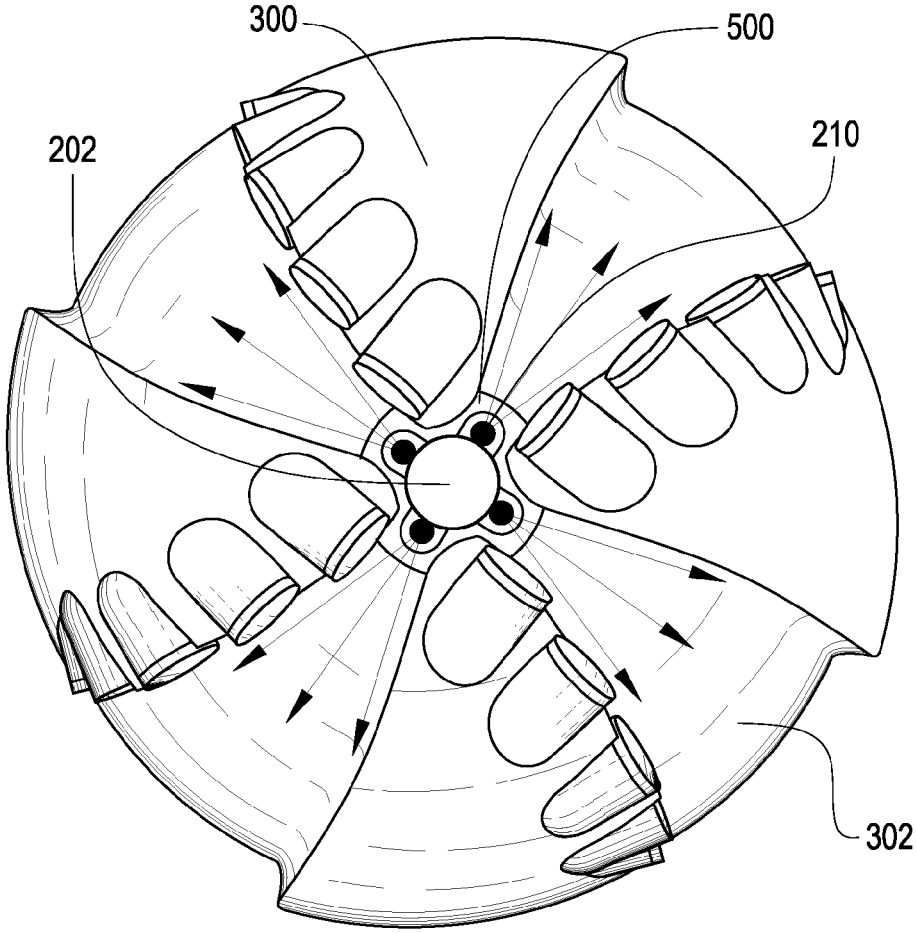
FIG. 5 is an orthogonal diagram of another embodiment of a drill bit.

The jets 210 may be formed in a ring 500 disposed around a jack element 202, as in the embodiment of FIG. 5. The jets 210 may be flush with the jack element 202, which may aid the jack element 202 in compressively failing the formation directly below it. Due to a larger volume of junk slots 302 from having fewer blades 300 in this embodiment, as in this embodiment, the jets 210 may be designed to emit a wider stream in order to clear the cuttings from the junk slots 302.

Figure 5A:
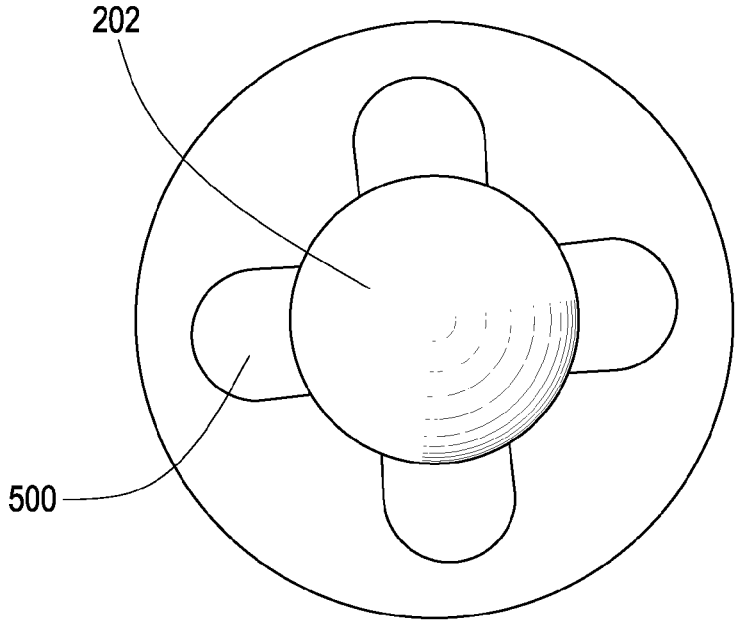
FIG. 5*a* is an orthogonal diagram of a distal end of a jack element.

The ring 500 may comprise a hard material selected from the group consisting of polycrystalline diamond, natural diamond, synthetic diamond, silicon bonded diamond, cobalt bonded diamond, thermally stable diamond, polished diamond, layered diamond, chromium, cubic boron nitride, tungsten carbide, titanium, niobium, or combinations thereof. The hard material may help protect the ring from experiencing excessive wear while the bit is in operation, though the ring 500 may also be replaceable in case of high wear. FIG. 5*a* depicts a ring 500 with recesses formed adjacent the jack element.

Figure 6:
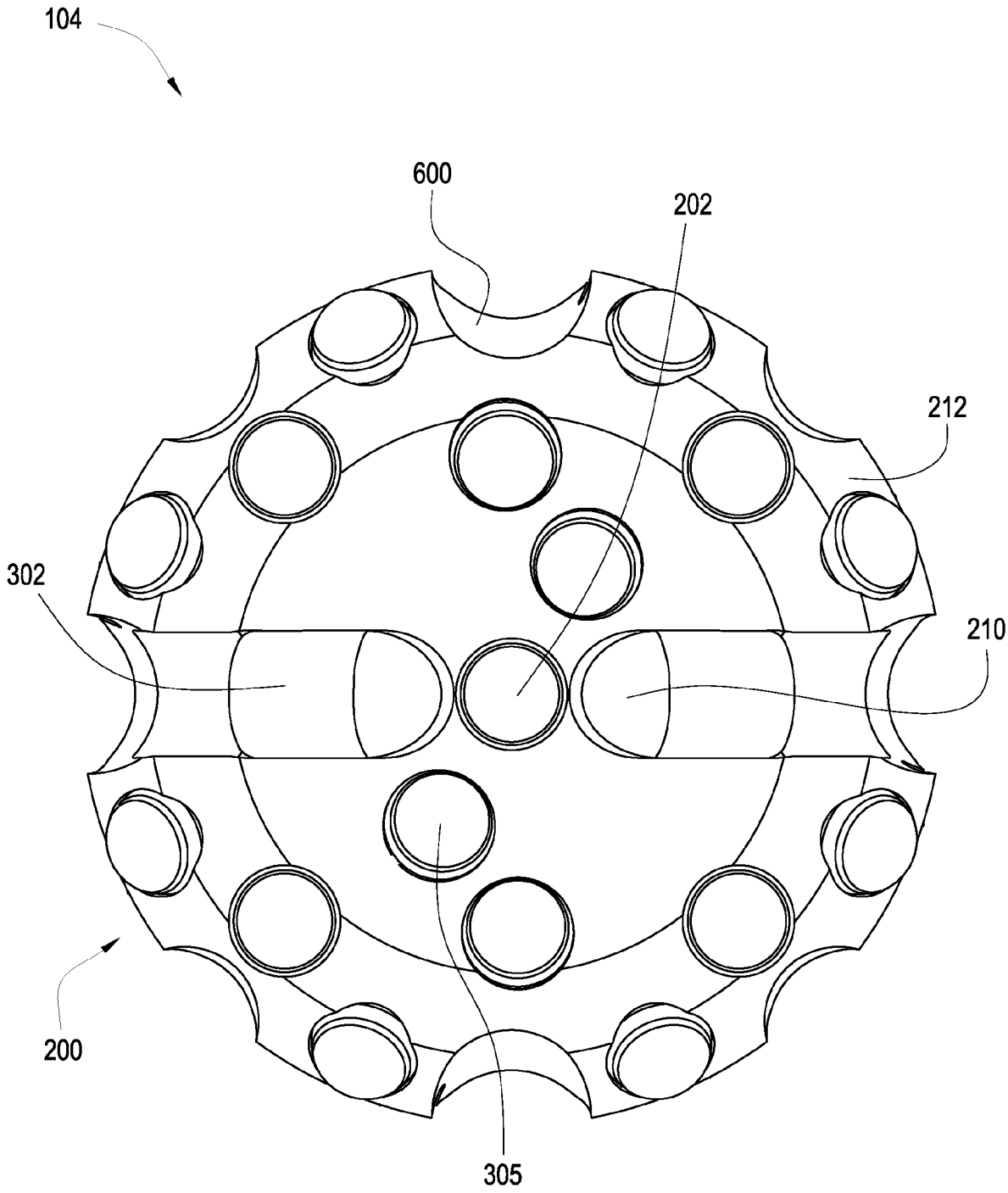
FIG. 6 is an orthogonal diagram of another embodiment of a drill bit.
Figure 7:
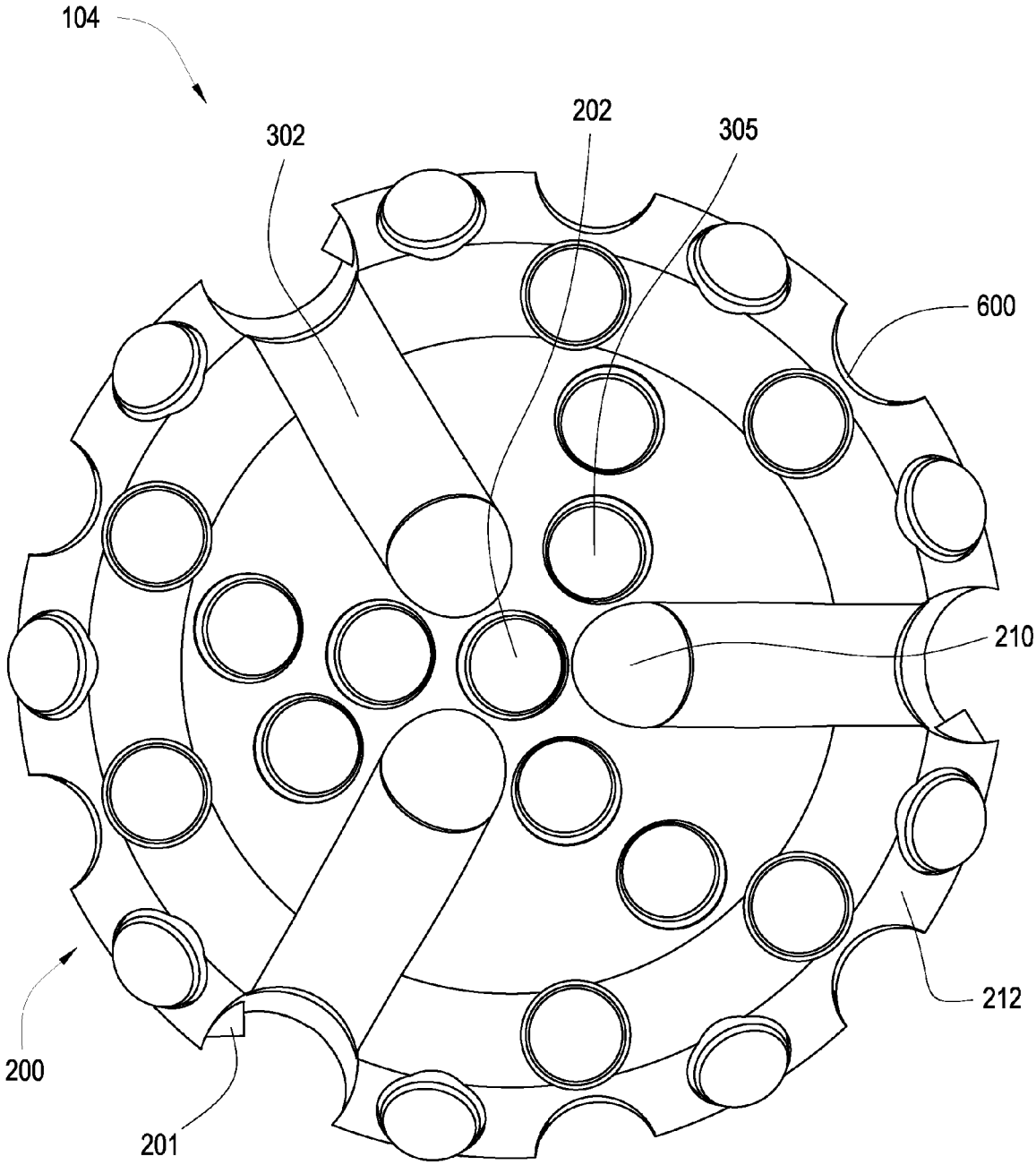
FIG. 7 is an orthogonal diagram of another embodiment of a drill bit.

The drill bit 104 may also be a percussion bit, as in the embodiments of FIGS. 6 and 7. The working face 200 may comprise at least 2 or 3 junk slots 302 within which jets 210 are disposed, the jets 210 being closer to the jack element 202 than the inner most cutting element 305. The junk slots 302 may also comprise cutting elements 201. The gauge 212 of the bit 104 may also comprise extra junk slots 600 which do not extend onto the working face 200. The percussion bit may rotate slowly as it impacts the formation to allow the emitted streams to generally equally erode the formation and clean the working face 200 of the bit 104.

Figure 8:
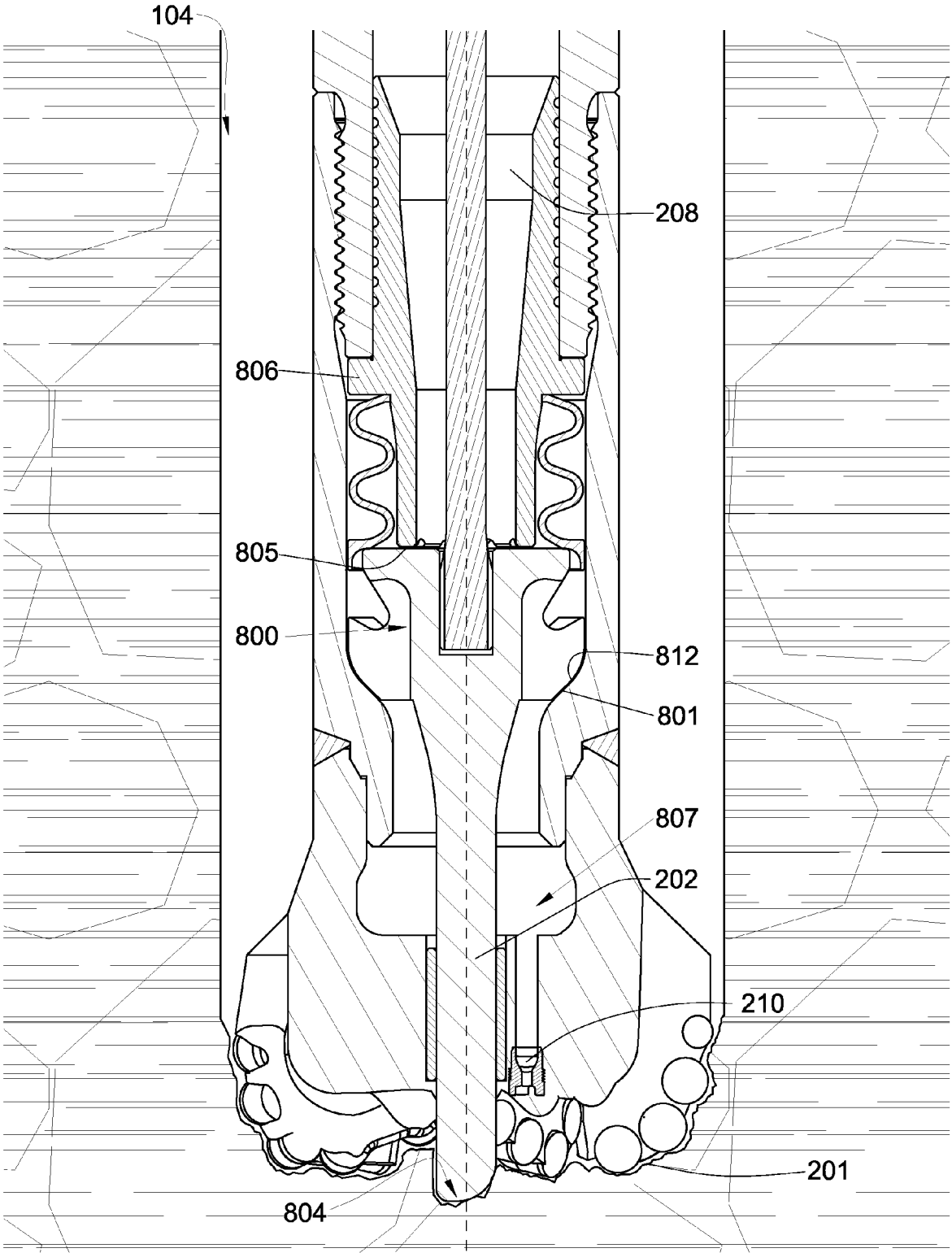
FIG. 8 is a cross-sectional diagram of another embodiment of a drill bit.

Referring to FIG. 8, the present invention may be used in conjunction with a drill bit 104 with an oscillating jack element 202. Pressure from fluid in the bore 208 of the drill bit 104 may apply a first axial force to a valve portion 800 of the jack element 202, causing the jack element 202 to be pushed downward until a shoulder 801 of the valve portion 800 abuts a shoulder 802 of the bore wall of the drill bit 104. This first axial force presses the jack element 202 into the formation, which causes an opposing axial force to be applied to a distal end 804 of the jack element 202. When the opposing axial force is greater than the first axial force, the jack element 202 is pushed upward until an upper surface 805 of the valve portion 800 of the jack element 202 abuts a stop element 806 disposed within the bore 208 or until the first axial force is again greater than the opposing axial force. The continual displacement of the jack element 202 in an axial direction may produce an oscillation. The distal end 804 of the jack element 202 may comprise an asymmetric geometry, which may aid in directional drilling.

As fluid is passed by the valve portion 800 of the jack element 200, pressure may build up in a cavity 807 near the working face 200 of the drill bit 104. This pressure may be used to regulate flow from a jet 210 disposed within the working face 200 and proximate the jack element 202. The jet 210 may clean the region in front of the cutting elements 201 on the working face 200. The jet 210 may also clear the cuttings from around the jack element 202 such that the jack element 202 may oscillate smoothly.

Figure 9:
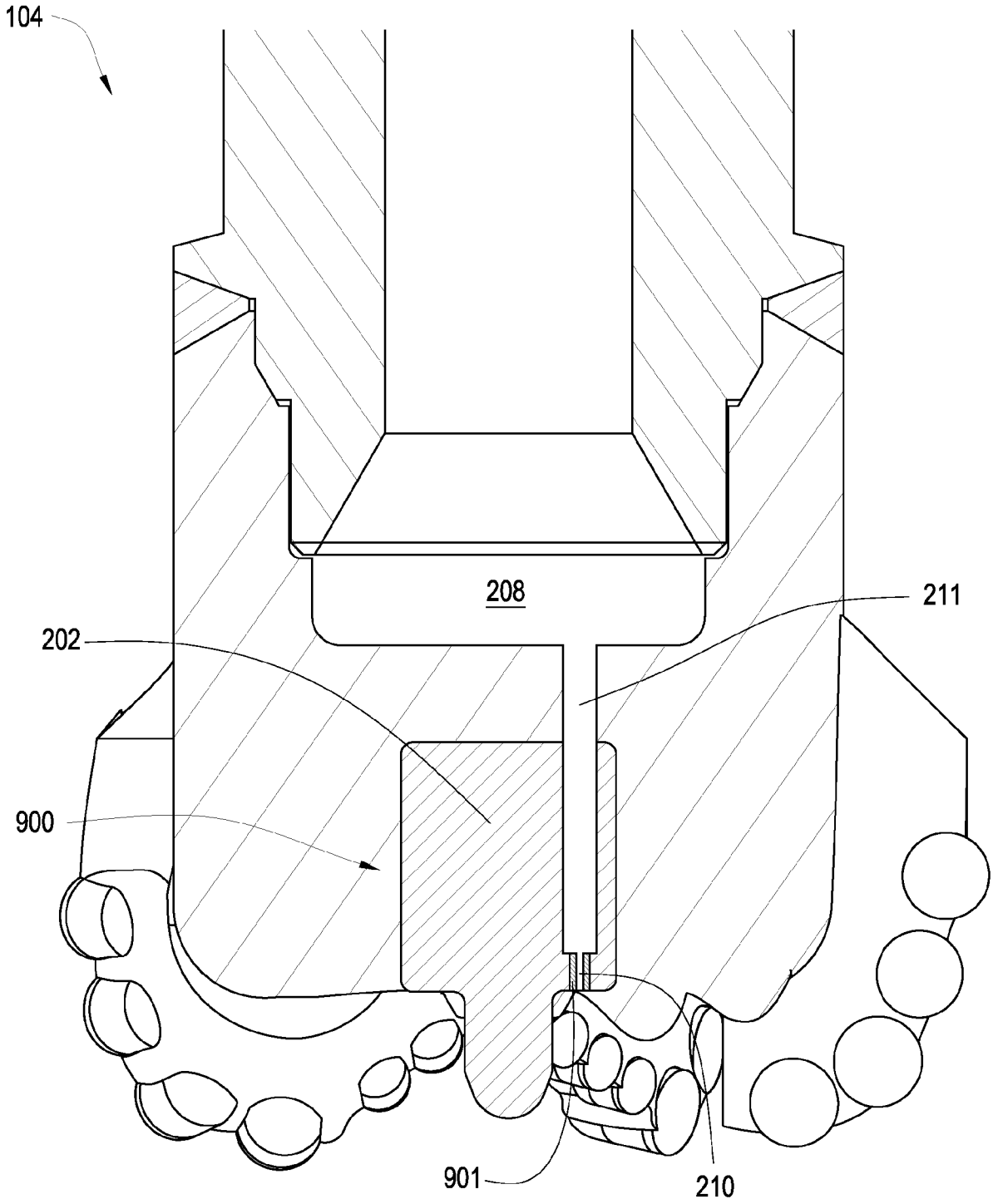
FIG. 9 is a cross-sectional diagram of another embodiment of a drill bit.

Referring to the drill bit 104 in the embodiment of FIG. 9, a portion of a fluid pathway 211 connecting the bore 208 of the bit 104 to the jet 210 may be disposed within the proximal end 900 of the jack element 202. The fluid pathway 211 may be drilled into the jack element 202 and drill bit 104 after the jack element 202 has been inserted into the working face 200. The jet 210 may be formed in the proximal end 900 of the jack element 202. A surface 901 comprising a hard material may line the inside of the jet 210, which may protect the jet 210 from wear due to high pressures and velocities of the fluid passing through the jet 210.

Figure 10:
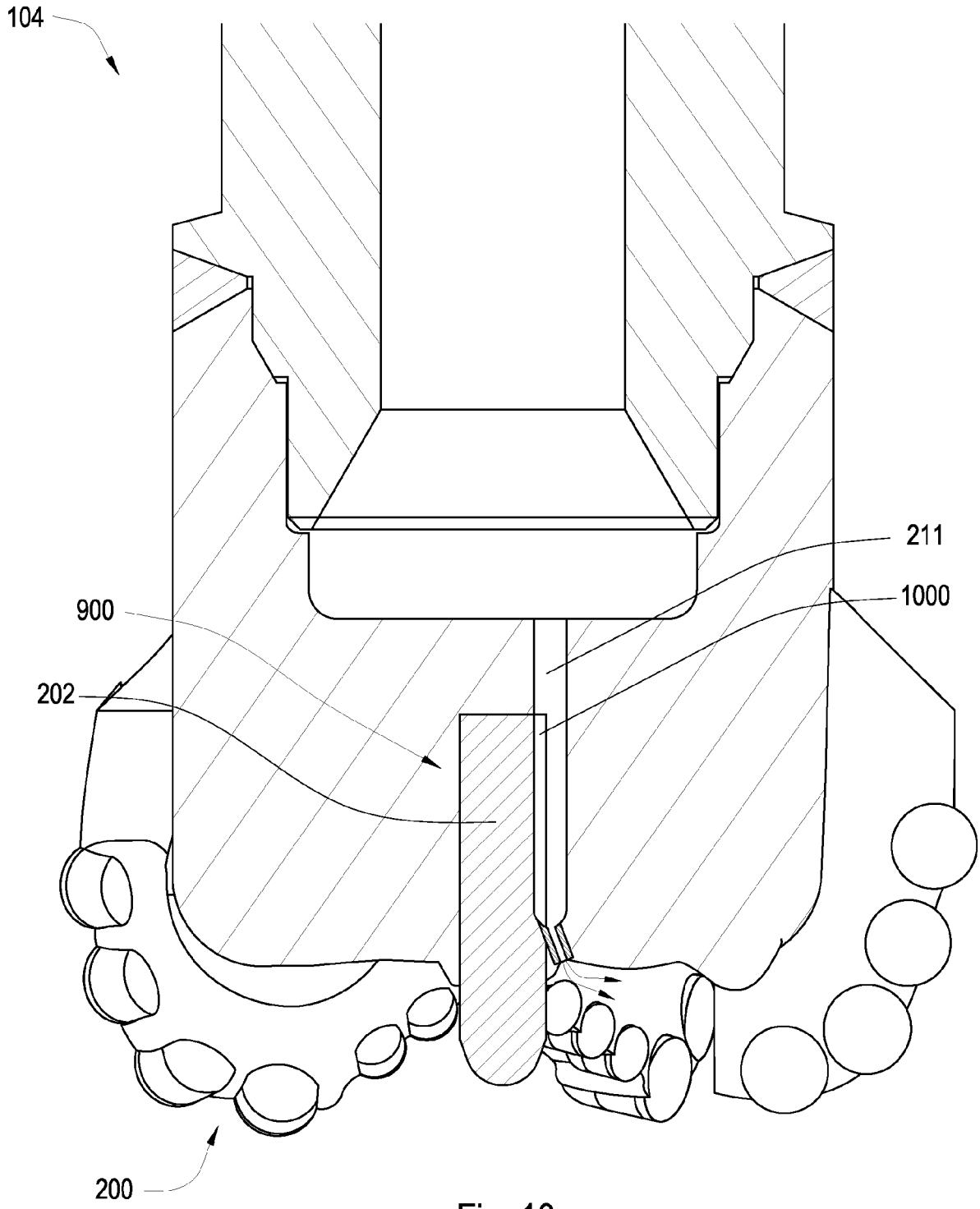
FIG. 10 is a cross-sectional diagram of another embodiment of a drill bit.

A portion of the fluid pathway 211 may be disposed within an axial groove 1000 in a side of the proximal end 900 of the jack element 202, as in the embodiment of FIG. 10. This may allow the jet 210 to be positioned closer to the jack element 202. An axial groove 1000 may provide the shortest path for the fluid to exit from the bore of the bit to well bore annulus. The axial groove also comprises a geometry that angles the stream of fluid in a direction that is non-perpendicular to the working surface 200 but that travels in a general direction of the junk slots 302.

Figure 11:
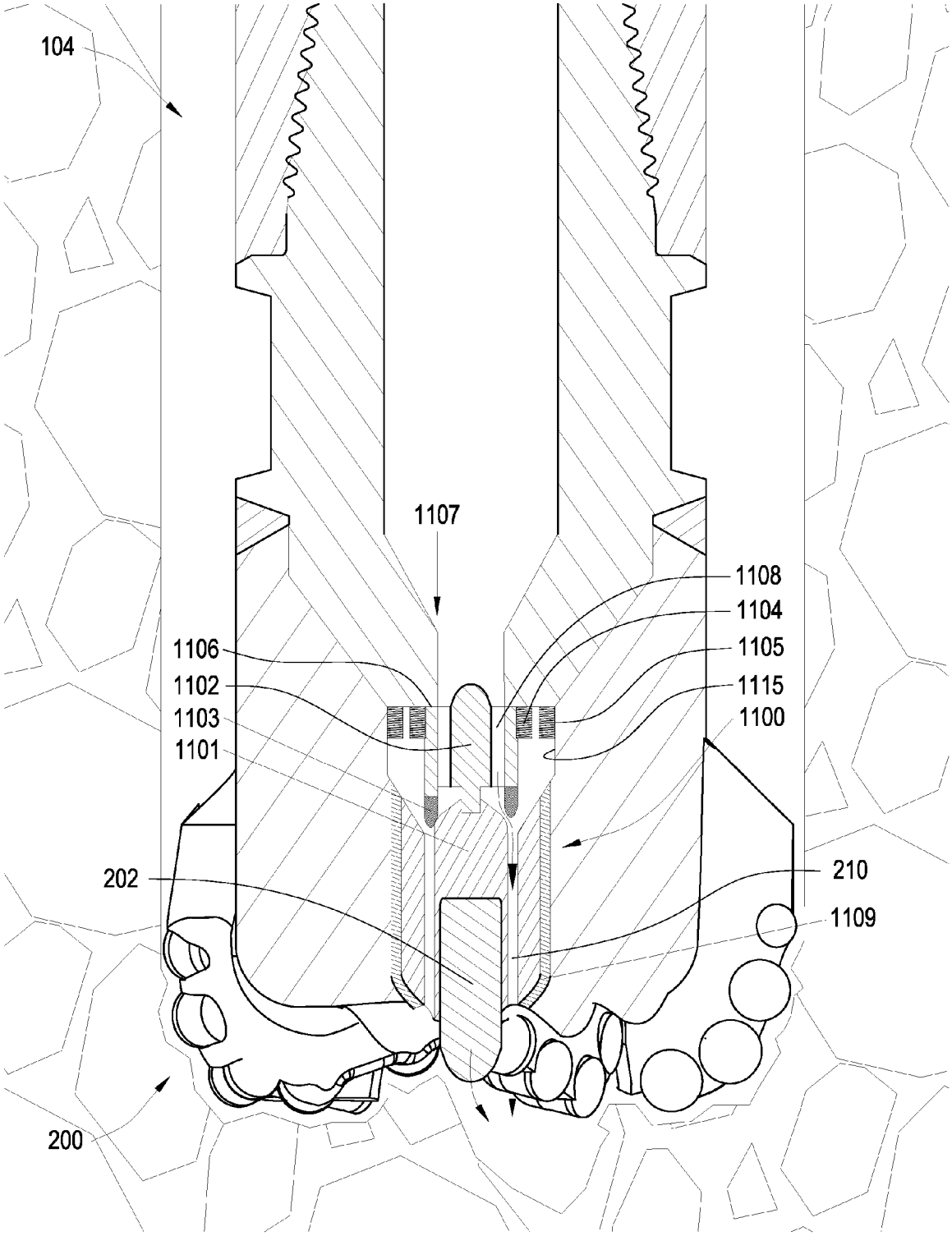
FIG. 11 is a cross-sectional diagram of another embodiment of a drill bit.

Now referring to FIG. 11, the drill bit 104 may comprise a steering system 1100 disposed within the bore of the bit 104 and proximate the working face 200. The jack element 202 may be disposed within the steering system 1100.

The steering system 1100 may comprise a first component 1101 in which the jack element 202 is disposed and in which the jets 210 are formed surrounding the jack element 202. A second component 1102 is attached to the first component 1101 opposite the jack element 202. The second component 1102 comprises a plurality of valves 1103, one proximate each jet 210. The first and second components 1101, 1102 are rotationally isolated from the drill bit. In some embodiments, the jack element 202 will be compressed into the formation and thereby remain stationary with respect to the formation, while the body of the drill bit rotates around it. In other embodiments a turbine, motor, or other system that may be attached in the drill bit or in another component of the drill string may orient the position of the jack and nozzles. A series of inductive couplers 1104 is attached to the second component 1102 and is in magnetic communication with a second series of inductive couplers 1105 attached to the bore wall 1115. The communication between these series of inductive coils 1104, 1105 allows data and/or power to be transmitted to the first and second components 1101, 1102. Data and power transferred to the first and second component 1101, 1102 may allow an operator to open and close the valves, and thereby control the flow of fluid from the jets 210. By selectively opening and closing the valves 1103, the erosion from the drilling mud may be controlled and concentrated to selective areas of the formation adjacent the jack element 202. It is believed that the jack element 202 will follow the path of greater erosion since there is less resistance and may guide the drill bit along complicated drilling trajectories. Opening and closing certain fluid pathways 1103 to the jets 210 at different times may allow the operator to steer the drill bit 104 with the jets 210. In situations where it is desired to steer in a straight trajectory all of the valves may be opened allowing the fluid erosion to occur generally equally around the jack element.

To prevent the steering system 1100 from being axially displaced within the bore 208, a portion 1107 of the bore wall may narrow above the second component 1102 such that a portion of an upper surface 1106 of the second component 1102 abuts the narrowing portion 1107 of the bore wall. The second component 1102 may comprise a plurality of bores 1108 such that fluid may pass into the jets 210 of the first component 1101.

The region of the bore 208 in which the first and second components of the steering system 1100 are disposed may comprise a bearing surface 1109 which allows the them to rotate independently of the drill bit 104. The narrowing portion 1107 of the bore wall may also comprise a bearing surface and/or a thrust bearing to allow the upper surface 1106 of the second component 1102 to rotate and to prevent wear.

Whereas the present invention has been described in particular relation to the drawings attached hereto, it should be understood that other and further modifications apart from those shown or suggested herein, may be made within the scope and spirit of the present invention.

What is claimed is:

1. A drill bit, comprising:

a bit body, an axis of rotation, and a working face, the working face comprising a plurality of fixed cutting elements;

a jack element extending from the working face and being coaxial with the axis of rotation and being a hard metal insert;

a plurality of high pressure jets disposed within the working face and surrounding the jack element;

wherein at least one jet is disposed at least as close to the jack element as an inner most cutting element of the plurality of cutting elements and wherein the at least one jet is formed in a portion of the jack element and the jack element is rotationally isolated from the bit body of the drill bit and at least one jet is rotationally fixed to the jack element.

2. The bit of claim 1, wherein the jack element comprises a surface comprising a material with a hardness of at least 63 HRc.

3. The bit of claim 2, wherein the material comprises a polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, polished diamond, course diamond, fine diamond, cubic boron nitride, chromium, titanium, matrix, diamond impregnated matrix, diamond impregnated carbide, a cemented metal carbide, tungsten carbide, niobium, or combinations thereof.

4. The bit of claim 1, wherein the jack element is adapted to compress a portion of a downhole formation during operation of the bit, the compressed portion of the formation being formed such to direct a stream emitted from the jets.

5. The bit of claim 1, wherein at least a portion of a fluid pathway connecting a bore of the bit body to the at least one jet is disposed within a proximal end of the jack element.

6. The bit of claim 1, wherein a fluid pathway connects a bore of the bit body to a plurality of jets.

7. The bit of claim 1, wherein the jets are adapted to apply at least 5,000 psi.

8. The bit of claim 1, wherein the jets are disposed within junk slots in the working face.

9. The bit of claim 8, wherein the junk slots comprise a width from 0.75 inches to half the distance between adjacent arrays of cutting elements.

10. The bit of claim 8, wherein the junk slots comprise a depth from 0.6 inches to 2 inches.

11. The bit of claim 1, wherein the at least one jet is flush with the jack element.

12. The bit of claim 1, wherein the at least one jet is closer to the jack element than the inner most cutting element.

13. The bit of claim 1, wherein the at least one jet is directed towards a distal end of the jack element.

14. The bit of claim 1, wherein the at least one jet is angled such that it emits a stream in a direction non-perpendicular to the working face.

15. The bit of claim 1, wherein the at least one jet is formed in a ring disposed around the jack element.

16. The bit of claim 15, wherein the ring comprises a hard material selected from the group consisting of polycrystalline diamond, natural diamond, synthetic diamond, silicon bonded diamond, cobalt bonded diamond, thermally stable diamond, polished diamond, layered diamond, chromium, cubic boron nitride, tungsten carbide, titanium, niobium, or combinations thereof.

17. The bit of claim 1, wherein the bit is a shear bit or a percussion bit.

18. The bit of claim 1, wherein at least one valve is adapted to open or close at least one of the jets.

19. A drill bit, comprising:

an axis of rotation and a working face comprising a plurality of blades extending outwardly from a bit body;

the blades forming in part a plurality of junk slots which converge proximate the axis of rotation and diverge radially towards a gauge of the bit;

a plurality of cutting elements comprising a cutting surface arrayed along the blades; and a jack element coaxial with the axis of rotation and being a hard metal insert;

a plurality of high pressure jets disposed within the working face and surrounding the jack element, the jets being adapted to apply at least 5,000 psi;

wherein at least one jet is disposed at least as close to the jack element as an inner most cutting element attached to at least one of the plurality of blades and wherein the at least one jet is formed in a portion of the jack element and the jack element is rotationally isolated from the bit body of the drill bit and at least one jet is rotationally fixed to the jack element.

* * * * *